US006020861A

United States Patent [19]

Jonsson et al.

[11] Patent Number: 6,020,861

[45] Date of Patent: Feb. 1, 2000

[54] ELONGATED ANTENNA

[75] Inventors: Stefan Jonsson, Stocksund; John Pettersson, Stockholm; Bo Karlsson, Österskär, all of Sweden

[73] Assignee: Allgon AB, Akersberga, Sweden

[21] Appl. No.: 08/865,068

[22] Filed: May 29, 1997

[30] Foreign Application Priority Data

May 29, 1996 [SE] Sweden ..... 9602080

[51] Int. Cl.[7] ..... H01Q 9/28

[52] U.S. Cl. ..... 343/800; 343/795; 343/812

[58] Field of Search ..... 343/800, 729, 343/793, 798, 795, 810, 813, 814, 816, 815

[56] References Cited

U.S. PATENT DOCUMENTS

| | | | |
|---|---|---|---|
| 2,945,231 | 7/1960 | Scheldorf | 343/800 |
| 3,303,506 | 2/1967 | Diebold | 343/872 |
| 3,394,379 | 7/1968 | Pickles | 343/800 |
| 5,724,051 | 3/1998 | Mailandt et al. | 343/795 |

FOREIGN PATENT DOCUMENTS

| | | | |
|---|---|---|---|
| 2136046 | 2/1973 | Germany . | |
| 1414870 | 3/1972 | Sweden | 21/12 |
| 1414870 | 3/1973 | United Kingdom . | |

*Primary Examiner*—Don Wong
*Assistant Examiner*—James Clinger
*Attorney, Agent, or Firm*—Jacobson, Price, Holman & Stern, PLLC

[57] ABSTRACT

An elongated antenna, especially an omnidirectional antenna, has a vertical, elongated rod-like structure with two metal profile elements (10, 20) provided with dipole elements (2) as integral parts thereof. The rod-like structure (1) is surrounded by a tube (3). The antenna elements (2) are coupled in parallel to a single transmission coaxial cable (8). The antenna has a high gain and low losses.

20 Claims, 2 Drawing Sheets

ELONGATED ANTENNA

BACKGROUND OF THE INVENTION

1. Field of the Invention

The present invention relates to an elongated, preferably an omnidirectional antenna, comprising an elongated rod-like structure, which is provided with a number of antenna elements located at two or more longitudinal positions. The invention also concerns a metal joint element for use in an antenna structure.

2. Description of the Related Art

Such antennas, especially omnidirectional antennas, being used today are often designed as a colinear arrangement of dipole antenna elements coupled in series to a transmission line. Although there is a general need for a high gain within a fairly wide frequency band, e.g. in a range of about 150 MHz to around 1900 MHz, the existing antennas of this kind only permit rather narrow frequency ranges with an acceptable gain, which is a disadvantage in cellular telephone systems.

There are also other known antennas having antenna elements being fed in parallel from a corresponding number of coaxial cables. Of course, such parallel feed cables will cause energy losses and increase the complexity and make the antennas more expensive.

SUMMARY OF THE INVENTION

The main object of the present invention is to provide an antenna which is easy to assemble at low cost and which is highly efficient with low losses and a high gain within a relatively wide frequency range.

Further objects are to obtain a simple structure, which is robust and stable, and to provide an effective balun device being integrated with the structure.

The main object is accomplished in that the rod-like structure comprises first and second longitudinal metal profile elements extending in parallel to each other at a well-defined mutual distance. The antenna elements, in the form of dipole elements, and adjoining feed network portions constitute integral parts of said first and second metal profile elements, at least one dipole element being located at each longitudinal position, and said feed network portions being coupled in parallel to a single transmission coaxial cable.

Very few separate parts make up the antenna. Furthermore, since the antenna elements and the adjoining feed network portions are made in one piece with the structural profile elements, only a few connections between different metallic members are needed. Hereby, assembly is facilitated, and imperfect electrical contact with accompanying intermodulation products of the transmitted signal are avoided.

BRIEF DESCRIPTION OF THE DRAWINGS

The invention will now be described more fully with reference to the appended drawings.

DETAILED DESCRIPTION OF THE PREFERRED EMBODIMENTS

Figure 1:
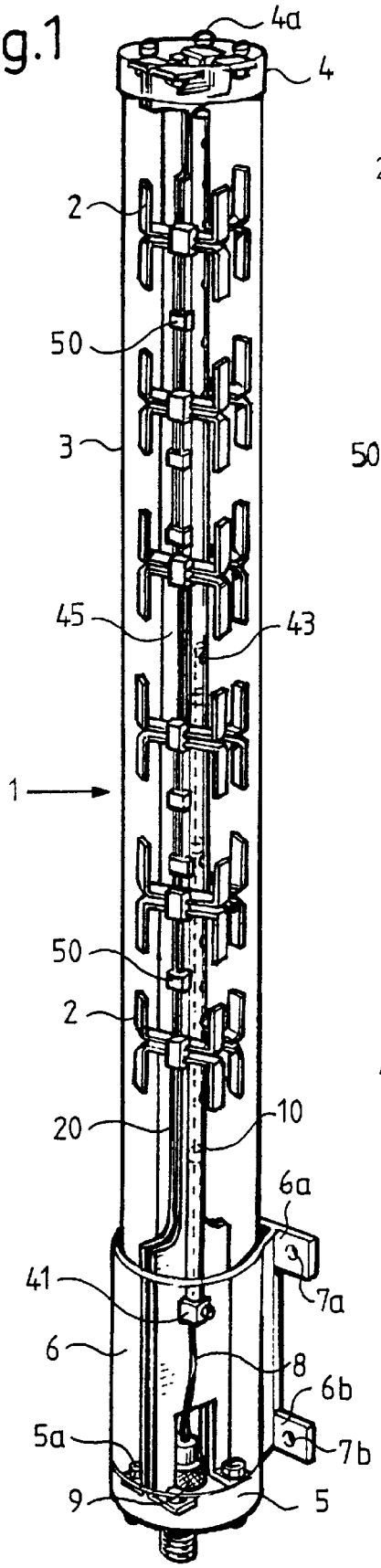
FIG. 1 shows in a perspective view an antenna according to the invention, an outer protective tube being shown transparent so as to make the internal structure visible.
Figure 2:
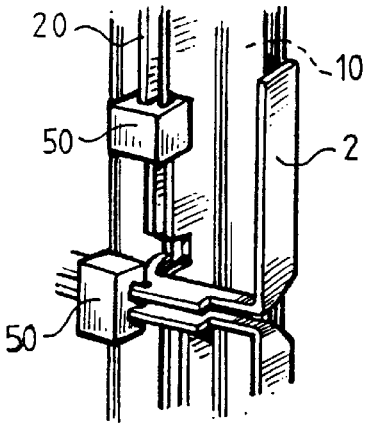
FIG. 2 shows, to a larger scale, a dipole antenna element included in the structure shown in FIG. 1.

The antenna shown in FIG. 1 is illustrated in a vertical position of use, normally at the top of a tower so as to extend freely upwards and enable omnidirectional radiation with generally horizontal direction and vertical polarization. Basically, the antenna comprises a vertical, elongated rod-like structure 1 (fully drawn in FIG. 1) provided with a number of dipole antenna elements 2 located at six different vertical levels. At each vertical level, there are four dipole antenna elements in the illustrated example (only three of them being visible in FIG. 1). The rod-like structure 1 is positioned inside a cylindrical tube 3, which is made of a fibre reinforced plastic material. In FIG. 1 the tube 3 is shown as being transparent in order to visualize the inside structure. The tube 3 is closed at the top and the bottom by means of end caps 4 and 5, respectively, and a holding sleeve 6 is securely fixed to the outside of the lower end portion of the tube 3. The holding sleeve 6 is provided with tongues 6*a*, 6*b* having holes 7*a*, 7*b*, so that the antenna can be secured to the non-illustrated tower by means of screw fasteners. Of course, there are two further tongues provided with holes at the backside which are not visible in FIG. 1. The rod-like structure 1 is securely fixed to the end caps 4 and 5 by means of screw fasteners 4*a* and 5*a*, respectively.

The dipole antenna elements 2 are all fed from a single coaxial transmission line 8 via a lead-through connector 9 at the bottom end cap 5.

Figure 4:
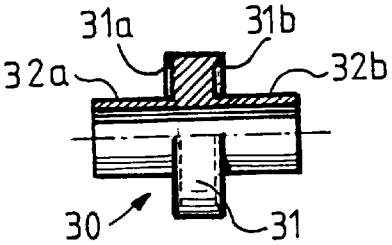
FIG. 4 shows the joint element separately.

In accordance with the present invention, the vertical rod-like structure 1 is constituted by two metal profile elements 10 and 20 extending in parallel to each other at a well-defined mutual distance. This mutual distance between the first profile element 10 and the second profile element 20 is defined by a number of joint elements 30, as shown separately in FIG. 4. Each joint element has a central, relatively wide part, the opposite end surfaces of which abut the corresponding surface of the respective profile element 10, 20, and relatively narrow, e.g. hollow end portions, serving to be fitted into corresponding holes in the respective profile elements and to be firmly secured thereto by riveting. The circumferential annular edges 31*a*, 31*b* of the relatively wide part 31 of the joint element are sharp and protrude somewhat in the axial direction so as to cut into and establish a good electrical connection with the material of each profile element 10, 20.

Figure 7:
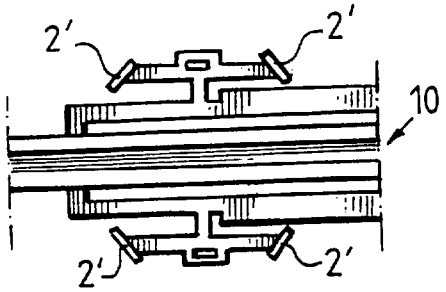
Figure 8:
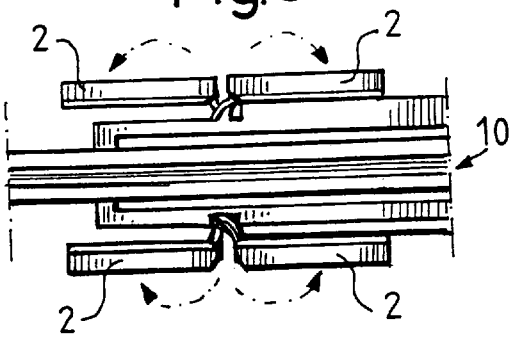
Figure 9:
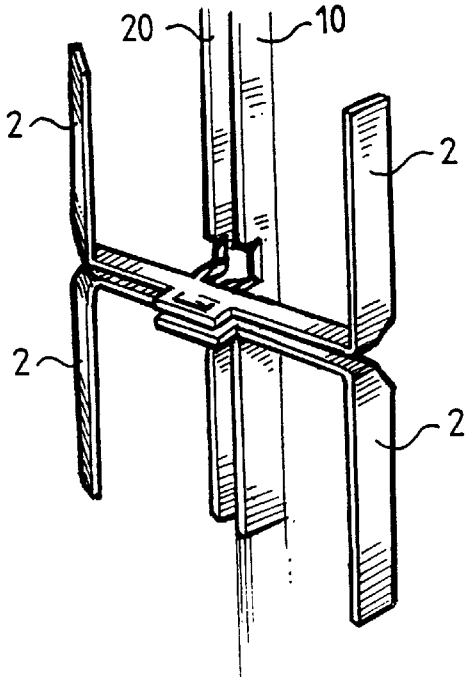

Each metal profile element, being made e.g. of an aluminum alloy, includes a central portion 11 and 21, respectively, forming a longitudinal channel or groove 12 and 22, respectively, and substantially planar side flanges 13, 14 and 23, 24, respectively, on each side of the central portion 11, 21. As clearly shown in FIG. 3, a central space is formed between the two profile elements, this space being defined by the two opposite, planar side walls of the profile elements facing each other. As will be apparent from FIGS. 1, 2, 6, 7, 8 and 9, the mutually parallel side flanges 13, 23, 14, 24 of the profile elements 10, 20 are integrally united with bent and twisted portions constituting the dipole antenna elements 2. FIGS. 6–9 illustrate the process of forming the dipole antenna elements 2. Starting from the profile element blank, e.g. the blank which is to form the first profile element 10, including a central portion 11 and planar side flanges 13, 14, a group of four tongues 2' and associated feeding strips 2" are machined, e.g. punched or cut out, so as to form a planar pattern in each region which is to form four dipole antenna elements and corresponding feeding network portions at a certain vertical level (compare FIG. 1). Next, the tongues 2' are bent upwardly about 90°, as shown in FIG. 7, and the two profile elements 10, 20 are joined together (at a small distance from each other) so as form the dipole elements and the adjoining feed network portions. Finally, the tongues are twisted so as to obtain vertical polarization, as appears from FIGS. 8 and 9.

Figure 3:
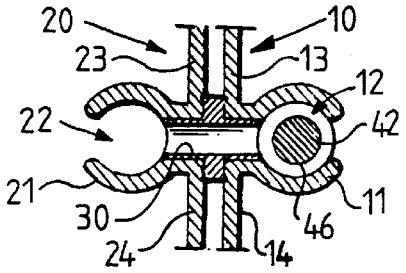
FIG. 3 shows a partial sectional view illustrating how two profile elements are held at a well-defined mutual distance by a joint element.
Figure 5:
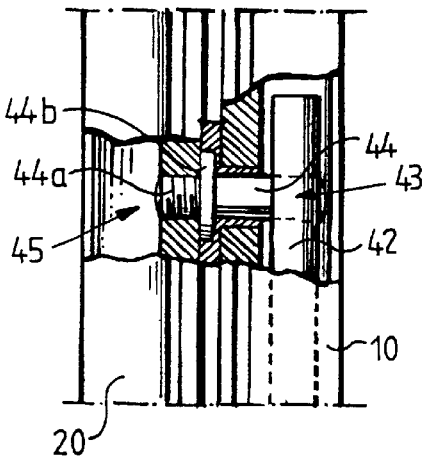
FIG. 5 illustrates, in a partial sectional view, how a feed conductor is coupled to the structure.
Figure 6:
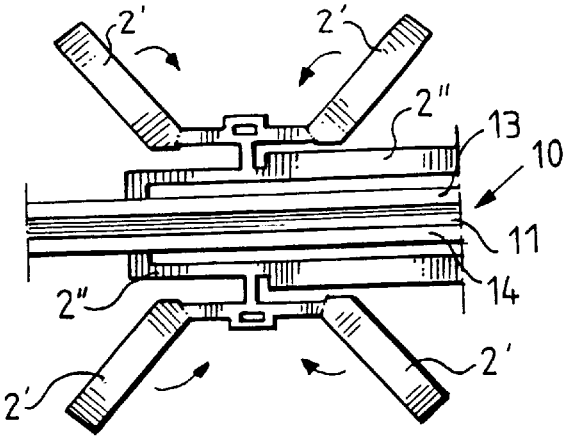
FIGS. 6–9 illustrate in side and perspective views how the dipole antenna elements are formed by machining, bending and twisting a profile element blank.

The outer conductor of the coaxial cable 8 is electrically connected to the first profile element 10 at a connector 41, whereas the inner conductor of the coaxial cable 8 is electrically connected to a metal rod 42 extending centrally within the groove 12, as shown in FIGS. 1 and 3. The metal rod 42 is held at a distance from the internal walls of the groove 12 by means of ring elements 46 of insulating material disposed at certain intervals. The metal rod 42 extends approximately half way up along the structure 1 to an end point 43. As shown in the detail view of FIG. 5, the metal rod is electrically connected, e.g. by a screw and soldering, to a transversal metal member 44, which extends through a transversal opening in the central portion of the profile member 10, where it is electrically insulated, and is electrically connected to the opposite, second metal profile member 20 by means of a threaded end portion 44*a* and, primarily, by an annular flange portion 44*b* which is provided with a sharp annular edge corresponding to one of the edges 31*a*, 31*b* shown in FIG. 4. In this way, the signal being transmitted through the metal rod 42 is transferred to the opposite metal profile member 20 at a feeding point 45, and an effective balun device is formed.

In this region, the central space between the two opposite metal profile elements 10, 20 is free from any obstructions upwards and downwards from the feeding point 45. This free central space is defined longitudinally by upper and lower metal joint elements 30. The signal arriving at the feeding point 45 will propagate upwards and downwards, the two opposite profile elements 10, 20 serving as a wave guide. Then, the signal will be passed on to the feed network portions and the dipole antenna elements 2. The dimension of the structure is such that a major part of the transmitted energy will be emitted as microwave energy from the dipole antenna elements 2. The material of the profile elements 10, 20 is somewhat flexible or resilient. Therefore, a number of plastic snap members 50 (see FIGS. 1 and 2) are mounted so as to keep the various portions of the structure, in particular the feed network portions holding the dipole antenna elements, in fixed positions.

It will be appreciated that the structure shown in FIG. 1 can be manufactured conveniently in series production at moderate cost. There are indeed a low number of separate parts to be assembled, and the assembly work will therefore be greatly facilitated. Apart from relatively low costs of production, the improved antenna will provide a high gain and good operative performance. Because of the particular structure, including the balun arrangement 44, and the good electrical connections between separate parts, especially by means of the joint elements 30, the overall performance has proven to be very good.

The elongated structure 1 provides an effective lightening protection due to its large cross-sectional area all along its length, including the connections to the end caps 4, 5. Furthermore, the inner conductor of the single coaxial cable 8 is grounded in the structure (at feeding point 45).

Of course, the improved antenna structure may be modified in many ways by those skilled in the art within the scope of the appended claims. The number of vertical levels of the antenna elements 2 may be varied from two to twelve or even higher. In case very many vertical levels are to be used, it is possible to branch off the feed line 42 so as to obtain two or more feeding points each feeding a moderate number of antenna elements above and below the particular feeding point.

The groove 12 of each profile element may be replaced by closed channels. However, the open grooves as shown in FIG. 3 are very convenient to use during production.

In omnidirectional antennas, there must be at least two dipole elements at each vertical level. However, in sector lobe antennas, it may be sufficient to dispose one dipole element at each longitudinal position. Furthermore, the antenna may be mechanically downtilted. The antenna may also be oriented horizontally, and the dipole antenna elements may be oriented at will.

We claim:

1. An elongated antenna with an elongated rod-like structure having a number of antenna elements located at at least two different longitudinal positions, comprising:

said rod-like structure comprises first and second longitudinal metal profile elements extending in parallel to each other at a mutual distance, said antenna elements comprising dipole elements integral with feed network portions which are integral with said first and second metal profile elements, at least one dipole element located at each longitudinal position, and said feed network portions coupled in parallel to a single transmission coaxial cable.

2. The antenna as defined in claim 1, said coaxial cable having an outer conductor connected to said first profile element and an inner conductor connected to said second profile element at a feeding point located between dipole elements located at different longitudinal positions.

3. The antenna as defined in claim 2, wherein the inner conductor of said coaxial cable is connected to a metal rod extending along and within a longitudinal channel, forming a central portion of said first profile element, up to an end point located at the same longitudinal position as said feeding point, said metal rod being held at a distance from the internal walls of said channel and said end point of said metal rod connected to said feeding point by means of a transversal metal member, which extends through an insulated lead-through opening in said first profile element to said feeding point at said second profile element, so as to form a balun.

4. Antenna as defined in claim 3, wherein said longitudinal channel has a substantially circular or rectangular cross-section.

5. The antenna as defined in claim 3, wherein said longitudinal channel forms a groove which is open at the side facing away from said second profile element.

6. The antenna as defined in claim 3, wherein at least one of said first and second profile elements has straight side flanges extending in a common plane on each side of a central portion accommodating a longitudinal channel.

7. The antenna as defined in claim 6, wherein said first and second profile elements are alike and are oriented with the side flanges located in two parallel planes so as to form a central space defined by two opposite, planar side walls.

8. The antenna as defined in claim 7, wherein said central space is interrupted longitudinally by metal joint elements, which connect said two opposite, planar side walls to each other.

9. The antenna as defined in claim 8, wherein one, two, three or four longitudinally distributed dipole elements are located on one side of said feeding point, and one, two, three or four longitudinally distributed dipole elements are located on the other side of said feeding point.

10. The antenna as defined in claim 9, wherein said elongated rod-like structure is substantially vertically oriented.

11. The antenna as defined in claim 8, wherein several metal joint elements are located in a row on each longitudinal side of said central space.

12. The antenna as defined in claim 8, wherein each of said metal joint elements comprises a central, relatively wide part, to establish the mutual distance between said first and second profile elements, and relatively narrow end portions fitted into a corresponding holes in the respective profile elements and firmly secured to the corresponding holes by riveting.

13. The antenna as defined in claim 12, wherein said central, relatively wide part has annular sharp edges that cut into said first and second profile elements and establish a good electrical connection between the first and second profiles.

14. The antenna as defined in claim 1, wherein said dipole elements and adjoining feed network portions are machined and deformed from a profile element blank having substantially planar side portions.

15. The antenna as defined in claim 14, wherein said blank material is deformed by bending and twisting so as to orient the dipole elements substantially in parallel with the longitudinal direction of said rod-like structure.

16. The antenna as defined in claim 15, wherein two or four dipole elements are located at each longitudinal position.

17. The antenna as defined in claim 1, wherein said first and second profile elements are mounted inside a tubular element of a dielectric material.

18. The antenna as defined in claim 17, wherein the end portions of said first and second profile elements are secured to closure members, said transmission coaxial cable extending through an opening in one of said closure members.

19. An antenna as defined in claim 17, further comprising a holding sleeve is securely fixed to the outside of an end portion of said tubular element.

20. A metal joint element for use in an antenna structure for obtaining a good electrical connection between two separate metal members comprising a central, relatively wide part establishing a mutual distance between said two separate metal members, and relatively narrow end portions fitted into corresponding holes in the respective metal member, the end portions firmly secured to the corresponding holes by riveting, and in that said central, relatively wide part is provided with annular sharp edges that cut into said two separate metal members and establish an electrical connection between the two separate metal members.

* * * * *